US007314017B2

(12) United States Patent
Moore

(10) Patent No.: US 7,314,017 B2
(45) Date of Patent: Jan. 1, 2008

(54) MECHANICAL FLEXOR DRIVE CONNECTOR SYSTEM FOR MODULAR CAUSEWAY SYSTEM

(75) Inventor: David George Moore, Escanaba, MI (US)

(73) Assignee: Oldenburg Group Incorporated, Glendale, WI (US)

( * ) Notice: Subject to any disclaimer, the term of this patent is extended or adjusted under 35 U.S.C. 154(b) by 23 days.

(21) Appl. No.: 11/243,792

(22) Filed: Oct. 5, 2005

(65) Prior Publication Data

US 2007/0074647 A1 Apr. 5, 2007

(51) Int. Cl.
*B63B 35/44* (2006.01)
*E02B 3/00* (2006.01)

(52) U.S. Cl. ..... 114/266; 114/263; 114/264; 114/267

(58) Field of Classification Search ..... 114/263, 114/264, 266, 267, 77 A, 242, 249
See application file for complete search history.

(56) References Cited

U.S. PATENT DOCUMENTS 3,105,675 A 10/1963 Blackburn
3,109,406 A 11/1963 Stockdale
3,558,036 A 1/1971 Wells
3,776,517 A 12/1973 Davis et al.
3,837,316 A 9/1974 Blackburn
3,949,699 A 4/1976 Heese et al.
4,177,531 A 12/1979 Illgner
4,335,670 A * 6/1982 Skaalen et al. ..... 114/249
4,453,488 A * 6/1984 Watchorn ..... 114/266
5,088,339 A 2/1992 Lochmoeller
5,386,970 A 2/1995 Trant
5,607,143 A 3/1997 Regal
5,649,333 A 7/1997 Chernjawski
5,735,228 A * 4/1998 Huang ..... 114/266
6,250,607 B1 6/2001 Strom
6,431,103 B1 8/2002 Meyerdiercks
6,463,869 B2 * 10/2002 Smith ..... 114/249

* cited by examiner

*Primary Examiner*—Lars A. Olson
*Assistant Examiner*—Daniel V. Venne
(74) *Attorney, Agent, or Firm*—Reinhart Boerner Van Deuren s. c.

(57) ABSTRACT

A flexor connector drive system for mechanical flexors of a modular causeway system includes a linear slide mechanism coupled to a linear drive located within a well on a first section of the causeway system. The linear slide mechanism is adapted to be driven out of the well by the linear drive and couple to a flexor located within a well on a second section of the causeway. Upon reversal of the linear drive, the linear slide mechanism pulls the flexor into the well on the first section, for interconnecting the two sections. The linear drive includes a high helix screw that provides high torque under high speed conditions for quickly moving the heavy flexor between the two sections.

33 Claims, 12 Drawing Sheets

MECHANICAL FLEXOR DRIVE CONNECTOR SYSTEM FOR MODULAR CAUSEWAY SYSTEM

BACKGROUND OF THE INVENTION

Field of the Invention

The present invention relates generally to floating structures, such as pontoons, barges and other floating structures, that are adapted to be interconnected in an end-to-end or side by side fashion, and more particularly, to a flexor connector system for drawing together, aligning and locking together two or more pontoons, barges and other floating structures.

The connecting and locking together of pontoons, barges or other floating structures presents a difficult, dangerous and a labor intensive task. Pontoons, barges and the like, are often connected together on land or on the deck of an amphibious support ship and thereafter the completed assembly is deployed at sea by a means such as a crane.

A second alternative is to connect the pontoons or barges and the like in a sheltered inlet, cove, sea port or any place where the water is generally calm, when available, and then tow the assembly of pontoons or barges or other floating structures to a desired location.

However, these approaches of the past have serious limitations to the efficient and effective connecting and locking together of pontoons and barges or other floating structures for use in deep or open water ocean environments where the ocean may be rough. For example, When pontoons are assembled on the deck of a ship, significant deck space is required. Cranes are required for the assembly and placement of the pontoons in the ocean. In addition, there is also a large manpower requirement. The deck crews that interconnect the pontoons are exposed to hanging cables, guide wires, chains and the like as well as swinging pontoons, often weighing tens of tons, while they manually guide the pontoons together and activate connectors that secure the pontoons or barges together. Work performed by crew members under these conditions can lead to serious injury.

In addition, in the past pontoons and the like have been assembled at sea using rigid connectors. The use of rigid connectors to assemble pontoons provides for a continuous level deck surface since the relative position of all pontoons is fixed, which allows maximum flexibility in cargo layout, handling and storage. However, the use of rigid connectors to assemble pontoons has limitations. For example, when rigid connectors are used to assemble pontoons the connectors must be able to resist significant bending stresses and other forces placed on the connectors. Further, rigid connectors may require special hull geometry to allow for alignment of the connectors during connection with an adjoining pontoon or barge. Other factors which limit the use of rigid connectors in an ocean going environment include: the need for delicate jacking hardware and sophisticated rigging systems when using rigid connectors to couple adjacent pontoons, and the need for heavy wire ropes to resist dynamic loads.

In one known specific application, typically used by the United States Army, floating barge-like structures or pontoons are connected end-to-end, forming what is commonly referred to as a Modular Causeway System (MCS). Such systems include a plurality of MCS sections or craft. The MCS is an assemblage of interoperable and interchangeable components which constitute the Army's primary means of augmenting existing port facilities, or conducting logistics over-the-shore operations where no port is available due to shallow water or low-sloping beach gradients prevent access by deep draft vessels, or because ports are otherwise inaccessible or denied to deep draft shipping.

In the most basic sense, MCS's are floating platforms that enable the Army to move cargo from supply ships to a beach. The MCS's provide an interface between strategic sealift ships and lighters, and between the lighters and the beach or underdeveloped ports. Composed of different subsystem configurations, MCS's provide a platform to load/unload roll-on/roll-off (RO/RO) ships and a floating pier for extremely shallow water to depths that other lighterage can navigate to.

Two or more of the MCS craft can be connected together using large "flexors," which are extendible arms located at the front of each craft at the left side and/or at the rear of each craft at the right side. The mating craft includes recesses designed to receive the flexors when they are extended from the other MCS craft. Thus, the flexors are linking arms which are used to hold MCS craft together with the front of one craft being connected to the rear of another craft.

The MCS craft currently in use in forming MCS's rely on brute force on the part of sailors to extend and retract the flexors which weigh approximately 1100 pounds, and it will be appreciated that this is a back-breaking operation at best. There have been a number of injuries, some serious.

Accordingly, there is a need for a connector system and apparatus that is relatively simple in design, yet highly effective and that allows pontoons, barges or other floating structures to be coupled together at sea under any condition including extreme turbulence where waves are several feet in height. Further, the connector system and apparatus should minimize the risk of injury to the user and facilitate the drawing together, aligning and locking together of two or more adjoining sections or craft that form a modular causeway, for example.

It is accordingly the primary objective of the present invention that it provide a connector system and apparatus for drawing together, aligning and linking together two or more craft, pontoons, barges or other floating structures.

It is another objective of the present invention that it provide a connector system and apparatus for drawing together, aligning and linking together two or more craft, pontoons, barges or other floating structures to form a modular causeway.

It is a further objective of the present invention that it provide a connector system and apparatus that is simple in design and yet highly effective and that allows craft or other floating structures that are connected together to form a modular causeway system to be coupled together at sea under any condition including extreme turbulence.

Another objective of the present invention that it provide a connector system and apparatus that is simple in design and yet highly effective and that allows floating structures, pontoons or barges and the like to be coupled together at sea and which minimizes manpower.

A further objective of the present invention is that it provide a connector system and apparatus that minimizes the risk of injury to the user and facilitates the drawing together, aligning and locking together of two or more adjoining floating structures, pontoons, barges or the like for providing a modular causeway.

The connector system and apparatus of the present invention must also be of construction which is both durable and long lasting, and it should also require little or no maintenance to be provided by the user throughout its operating lifetime. In order to enhance the market appeal of the system and apparatus of the present invention, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention which provides a connector system and apparatus for drawing together, aligning and linking together two or more sections of a floatation system in a seawater environment. The connector system and apparatus, in accordance with the invention, include a flexor connector mounted for sliding movement within a first well of a first section and a connector drive system. The connector drive system includes at least one slide mechanism mounted within a well of a second section for sliding movement within the well of the second section, and at least one drive mechanism coupled to the slide mechanism for driving the slide mechanism toward the first section for coupling the slide mechanism to the flexor connector. The drive mechanism is reversible for driving the slide mechanism, with the slide mechanism coupled to the flexor connector, back into the well of the second section, thereby drawing the flexor connector from the at least partially into the well of the second section.

The drive mechanism includes a drive motor and a linear drive that is driven by the drive motor for imparting reciprocating linear movement to the slide mechanism. In accordance with the invention, the slide mechanism is adapted to be connected to the flexor connector automatically as the slide mechanism is driven towards the flexor connector and into engagement with the flexor connector. Moreover, subsequently when the two sections are being disconnected from one another, the slide mechanism is adapted to be disconnected automatically from the flexor connector as the slide mechanism drives the flexor connected back into the first well. The linear drive includes a drive screw apparatus includes a high helix screw that provides high torque under high speed conditions. The first and second sections can be modular causeway craft, pontoons, barges, or the like that are interconnected to form a modular causeway system.

In accordance with the invention, the drive motor is relocatable with respect to the slide mechanism, and including a portable cart adapted for movement along a deck surface of said section, the drive motor carried by the cart. Thus, the drive motor can be moved to any location on a section, allowing a single drive motor to be used for several linear drives at different locations on a section.

Further in accordance with the invention, there is provided a method for connecting together first and second sections of a modular causeway system, wherein one of the sections includes a flexor connector located within a first well on the first section. The method includes the steps of providing a slide mechanism within a second well located on the second section; aligning the first and second sections in an end-to-end or side-by-side orientation with the first well aligned with the second well; transmitting linear motion to the slide mechanism to cause the slide mechanism to be moved out of the second well and at least partially into the first well; coupling the slide mechanism to the flexor connector in the first well; and reversing the drive to cause the slide mechanism to be retracted back into the second well along with at least a portion of the flexor connector.

It may therefore be seen that the present invention teaches a connector system and apparatus for drawing together, aligning and linking together two or more sections of a floatation system in a seawater environment. In interconnecting two sections, a slide mechanism within a well of one of the sections is driven by a linear drive to the other section where it automatically couples to a flexor connector. The slide mechanism is retracted back into the well of the one section, drawing with it the flexor connector. The connection of the slide mechanism to and the disconnection of the slide mechanism from the flexor connector is provided automatically. In addition, the linear drive includes a drive screw apparatus having a high helix screw that provides high torque under high speed conditions. The drive screw apparatus is driven by a drive motor that is portable and can be moved to any location on a section, allowing a single drive motor to be used for several linear drives at different locations on a section.

In contrast to current techniques which rely on brute force on the part of sailors to extend and retract the flexor connectors, the present invention provides a mechanical drive that is mounted in the portions of the MCS craft that are adapted to receive the flexor connectors from a mating MCS craft, and are operable to extend out, latch onto the flexor connector on an adjacent MCS craft, and pull the flexor connector into the mating opening in the MCS craft in which the mechanical drive is mounted. The mechanical drive can be operated by a portable DC drive motor which can be rolled into position on the deck of the MCS craft and coupled to the mechanical drive.

The apparatus of the present invention is of a construction which is both durable and long lasting, and which will require little or no maintenance to be provided by the user throughout its operating lifetime. The apparatus of the present invention is also of inexpensive construction to enhance its market appeal and to thereby afford it the broadest possible market. Finally, all of the aforesaid advantages and objectives are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
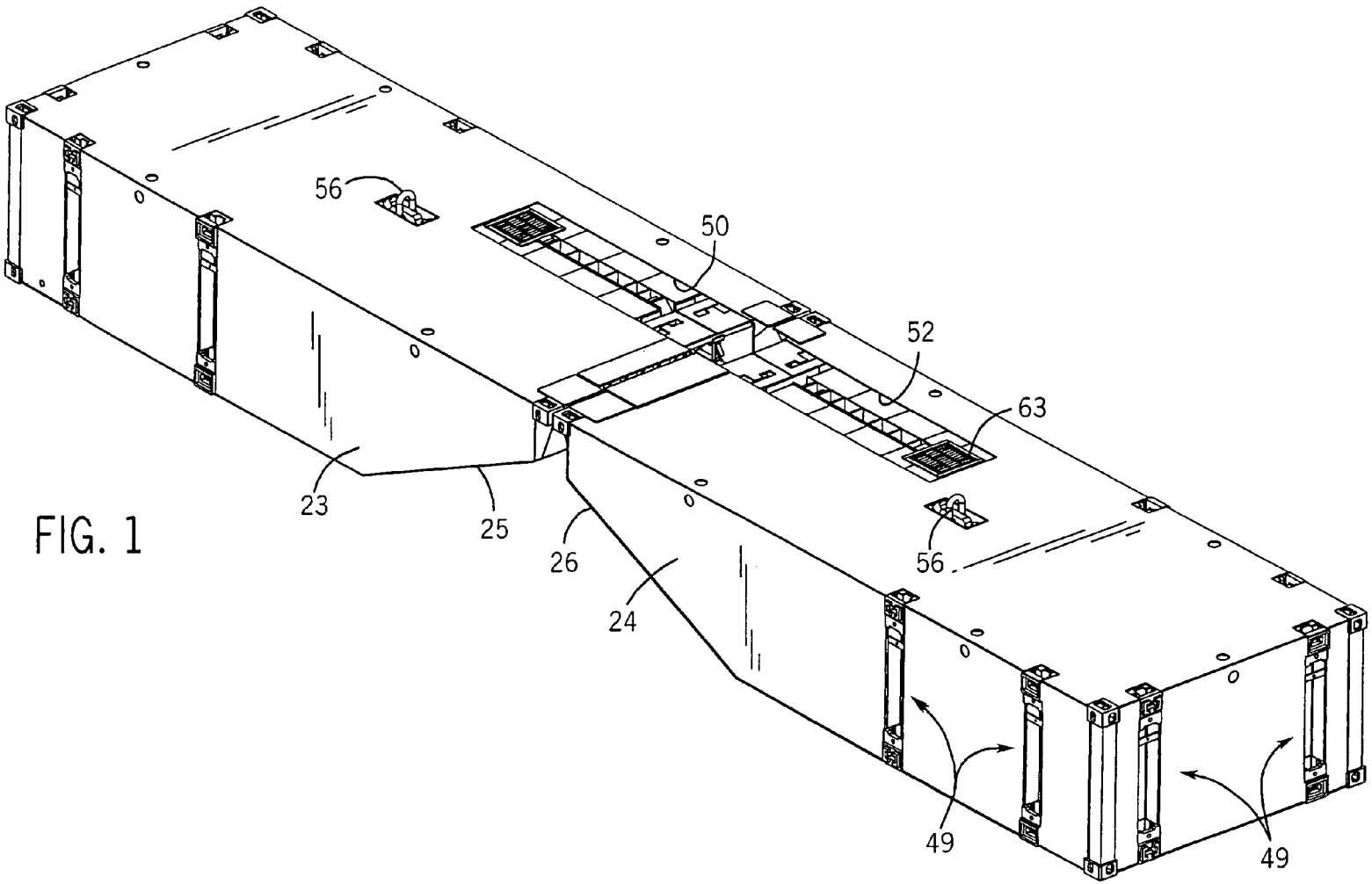
FIG. 1 is a perspective view illustrating modules of first and second sections of a modular causeway system that incorporates the flexor connector drive system provided by the present invention.
Figure 3:
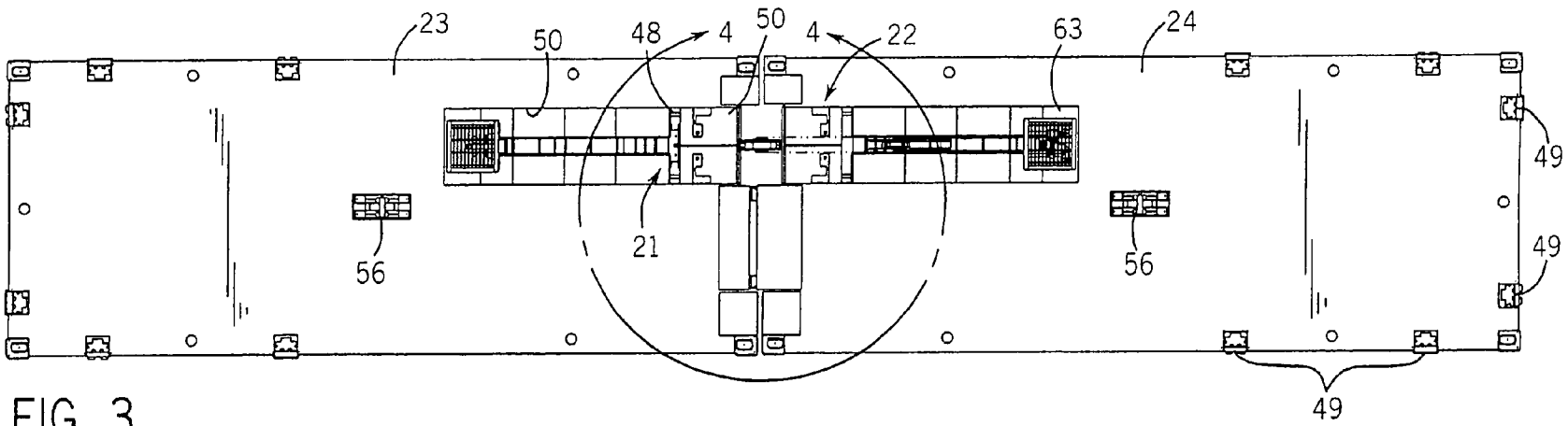
FIG. 3 is a top plan view of the modular causeway system sections of FIG. 1 and showing the flexor connector drive system of the present invention.
Figure 4:
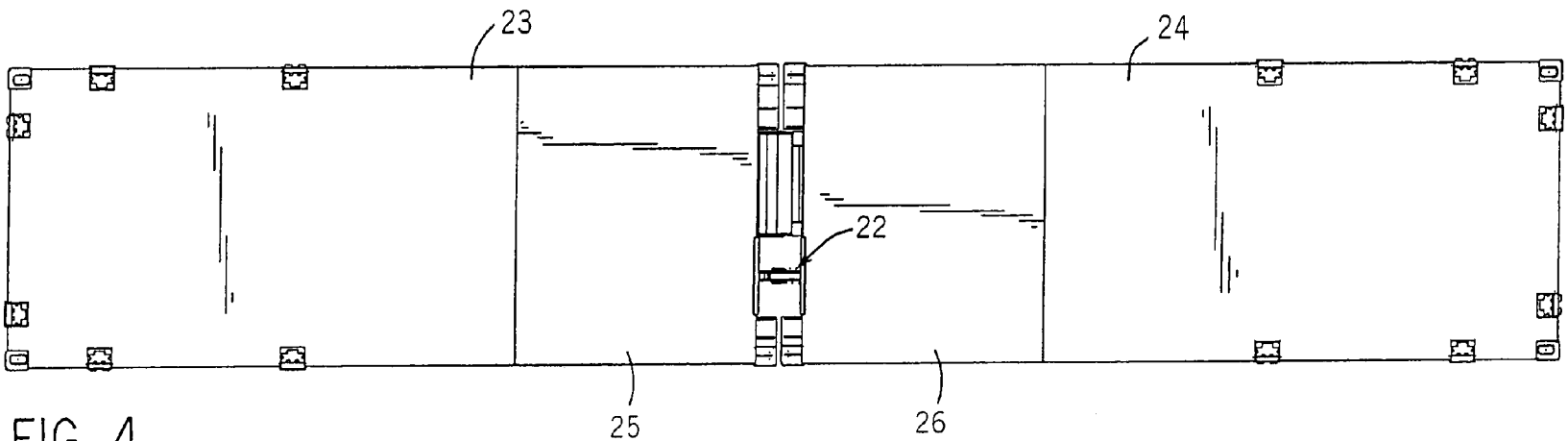
FIG. 4 is a bottom plan view of the modular causeway system sections and flexor connector drive system of FIG. 3.

Referring to FIGS. 1 and 3, the flexor connector system of the present invention is described with reference to an application in modular causeway systems (MCS) of the type used by the United States Army. The flexor connector system includes a flexor connector 21 and a flexor connector drive system, indicated generally by reference numeral 22, that is used to facilitate the interconnection of MCS sections, such as sections 23 and 24, of a modular causeway system. Such modular causeway systems provide a means to move cargo from ship to shore across unimproved beaches in areas of the world where fixed port facilities are unavailable, denied or otherwise unacceptable. In such modular causeway systems, a plurality of MCS sections, represented by components 23 and 24 in FIG. 1, can be joined together in different configurations to form buoyant vessels suitable for use in many different applications. To simplify the drawings and the description of the invention, in FIG. 1, the two MCS sections 23 and 24 are represented by a single component. However, it should be understood that MCS sections generally are formed from a plurality of components. The MCS sections are composed of modular, International Standards Organization (ISO) compatible modules. By way of example, systems can be configured from basic modules in various configurations, including, but not limited to, a roll-on/roll-off discharge facility (RRDF); a causeway ferry (CF); a floating causeway (FC); and a warping tug (WT).

The MCS is termed modular because it is made up of a plurality of MCS sections each of which can be formed from a plurality separate modules. A plurality of modules are interconnected to form MCS sections and a plurality of MCS sections can be interconnected to form other systems, including those listed above.

Figure 2:
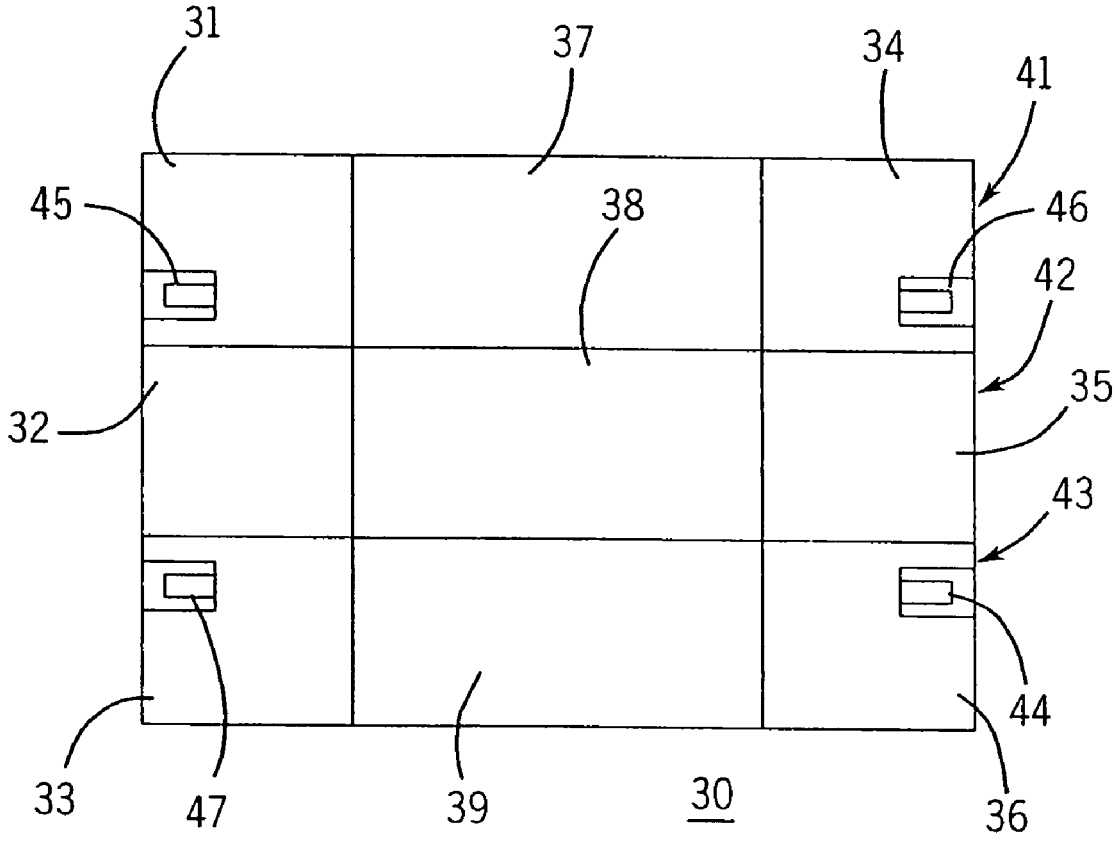
FIG. 2 is a simplified representation of a modular causeway section.

By way of example, FIG. 2 is a simplified representation of one known configuration for an MCS section 30, one application of which can be in the forming of a floating causeway. The MCS section 30 illustrated in FIG. 2 can include six end rake modules 31-36 and three pontoon modules 37-39. The pontoon modules 37-39 are buoyant type components that are generally parallelepiped in shape. The modular end rakes 31 and 36 commonly are referred to as left hand end rakes. The modular end rakes 33 and 34 commonly are referred to as right hand end rakes. The modular end rakes 32 and 35 commonly are referred to as center end rakes. The modular end rakes 31-36 have undersides that are tapered in the manner of the undersides 25 and 26 of the components 23 and 24 shown in FIG. 1. In FIG. 1, each MCS section is represented by a single end rake module, with one MCS section 23 being a left end rake module similar to left end rake 36 of one MCS section which, like MCS section 30, can include six end rake modules and three pontoon modules, and the other MCS section 24 being a right end rake module similar to right end rake 33 of a different MCS section which, like MCS section 30, can include six end rake modules and three pontoon modules.

For the configuration illustrated in FIG. 2, two end rake modules 31 and 34 are attached to a pontoon module 37 and these three interconnected modules are referred to as a string 41. Similarly, modules 32, 38 and 35 form a string 42 and modules 33, 39 and 36 form a string 43. Three such strings 41-43 connected together make up an MCS section, such as MCS section 30. Moreover, a plurality of MCS sections can be interconnected to form system configurations such as those referred to above. By way of a non-limiting example, the six end rake modules 31-36 can each be twenty feet in length, the three pontoon modules 37-39 can each be forty feet in length, and the modules 31-39 can each be eight feet in width, providing an MCS section that is eighty feet long by twenty-four feet wide.

The drive mechanism of the present invention provides can be powered by a portable DC drive motor. The mechanical drive is mounted in the portions of the MCS craft that are adapted to receive the flexors from a mating MCS craft, and are operable to extend out, latch onto the flexor on an adjacent MCS craft, and pull the flexor into the mating opening in the MCS craft in which the mechanical drive is mounted. Typically, there are two mechanical drives per MCS craft, at the right front and the left rear of the MCS craft. The portable DC drive motors that drive the mechanical drives can be rolled into position on the deck of the MCS craft.

The causeway section 30 has flexor connectors 44 and 45 at opposite ends to permit coupling with other causeway sections. Components 31 and 36 can be identical, but with component 31 rotated 180° relative to the component 36 which is located at opposite end of the MCS section 30. The causeway section 30 has a flexor drive systems 46 and 47 at opposite ends for receiving flexor connectors of other causeway sections to permit coupling with the other causeway sections. There can be two mechanical drives 46 and 47 per craft. One mechanical drive 46 is located in the right front component 33 and the other mechanical drive 47 is located in the left rear component 34. Components 33 and 34 can be identical but with component 33 rotated 180° relative to the component 34 which is located at the opposite end of the MCS section 30. Moreover, some causeway sections also can have side-mounted flexors (side connectors) to permit assembly into a three-causeway wide by two causeway long floating platform.

Figure 5:
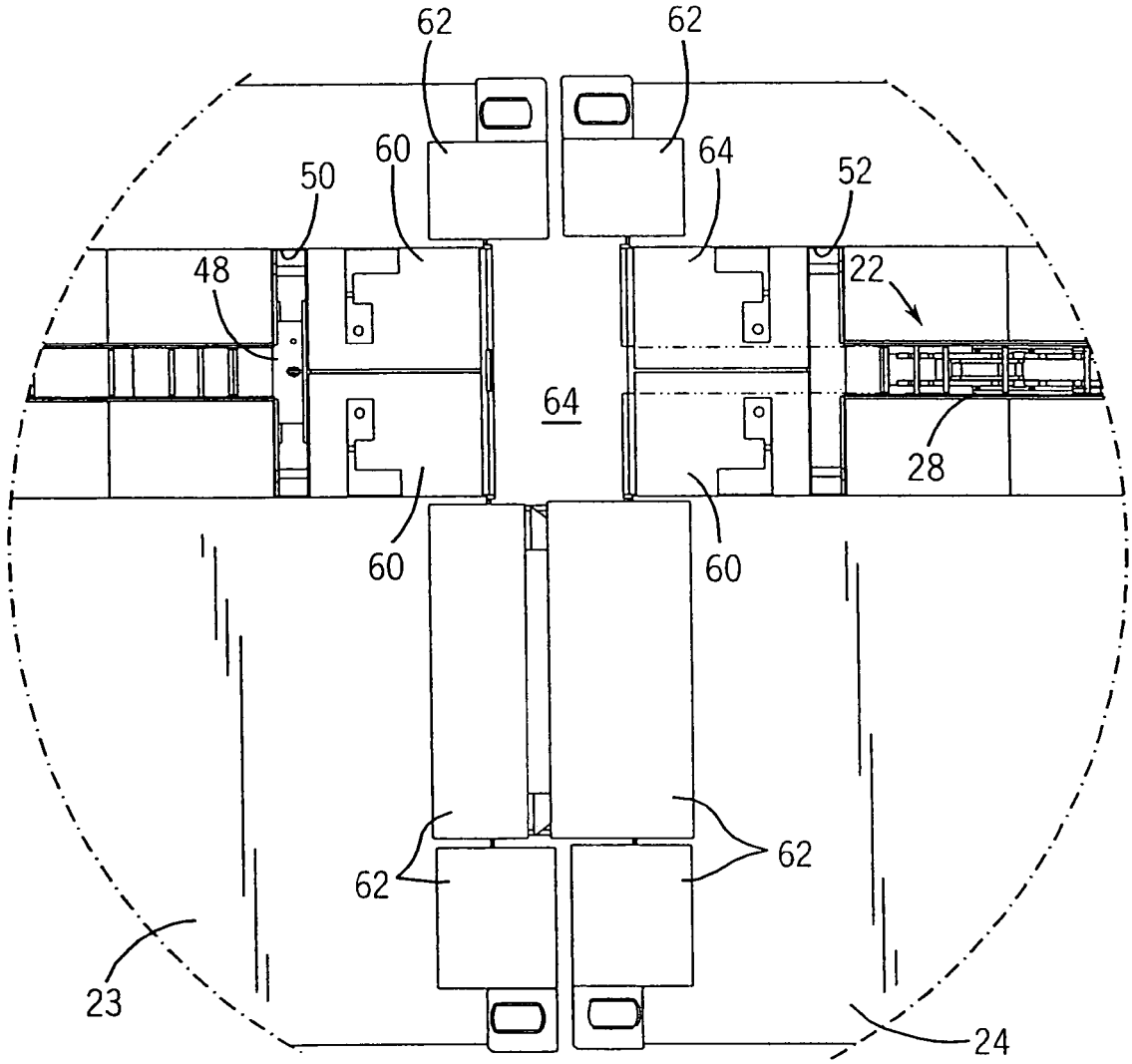
FIG. 5 is an enlarged view of the portion of the modular causeway system sections that are contained within the circle in FIG. 3 and with a flexor connector drive of one modular causeway system section shown retracted.

Referring to FIGS. 1 and 5, the left end rake module 23 includes a flexor connector 48 (FIG. 5) located within a flexor well 50 that opens to the upper surface of the module 23 and to one end of the module. The right end rake module 24 includes the flexor connector drive system 22 located within a flexor well 52 that opens to the upper surface of the module 24 and to one end of the module, allowing the well 52 to be aligned with the well 50 when the modules are aligned in an end-to-end relation. The modules 23 and 24 can include an eyebar 56, or the like, for receiving a winch hook 57 attached to the end of a wire rope 59 (FIG. 16) of a winch mechanism 58 that can be used to draw the two MCS sections 23 and 24 together to facilitate interconnecting the modules.

Referring to FIGS. 1 and 3-5, the MCS sections 23 and 24 can be locked together by locking mechanisms including flexor connectors, such as flexor connector 48 (FIG. 5), and shear-type connectors 49 as is known. As will be shown, in accordance with the invention, the flexor connector drive system 22 is operable to draw the flexor connector 48 of the MCS section 23 into a flexor well 52 of mating MCS section 24 to connect and lock together the two MCS sections 23 and 24. The flexor connector drive system 22 allows for relatively simple coupling of MCS sections 23 and 24 in an ocean going environment where waves may be extremely high and the waters very turbulent, and in a way that minimizes the risk of injury to the user. Although the flexor connector drive system 22 is described with reference to an application in a modular causeway system, it should be understood that the flexor connector drive system 22 can also be adapted for use with other buoyant vessels and platforms, such as barges and causeways, which are used in the transportation of goods and in floating causeways, bridges, piers and docks, for example.

Each left end rake module, such as left end rake module 23, includes a flexor connector 48, and each right end rake module, such as right end rake module 24, includes a flexor connector drive system 22. In addition, the left and right end rake modules can include male and female lock assemblies that are spaced along lateral walls and end walls for locking the modules to adjacent modules in a section and/or craft, such as for the modules 31-39 that comprise the MCS section 30 (FIG. 2). The male and female locking assemblies can be similar to the locking assemblies that are disclosed in U.S. Pat. No. 4,928,616 issued to A. Robishaw et al. The male lock assembly includes a horizontally disposed locking pin for the right end rake shown in FIG. 1. The female lock assembly includes a socket for the right end rake (FIG. 1), for receiving the locking pin and for securing the locking pin in the socket. The locking pin is adapted for reciprocating movement between an extended position in which the locking pin is received in the socket of the female lock assembly and a retracted in which the locking pin is withdrawn into the module 24.

Flexor Connector System

Figure 6:
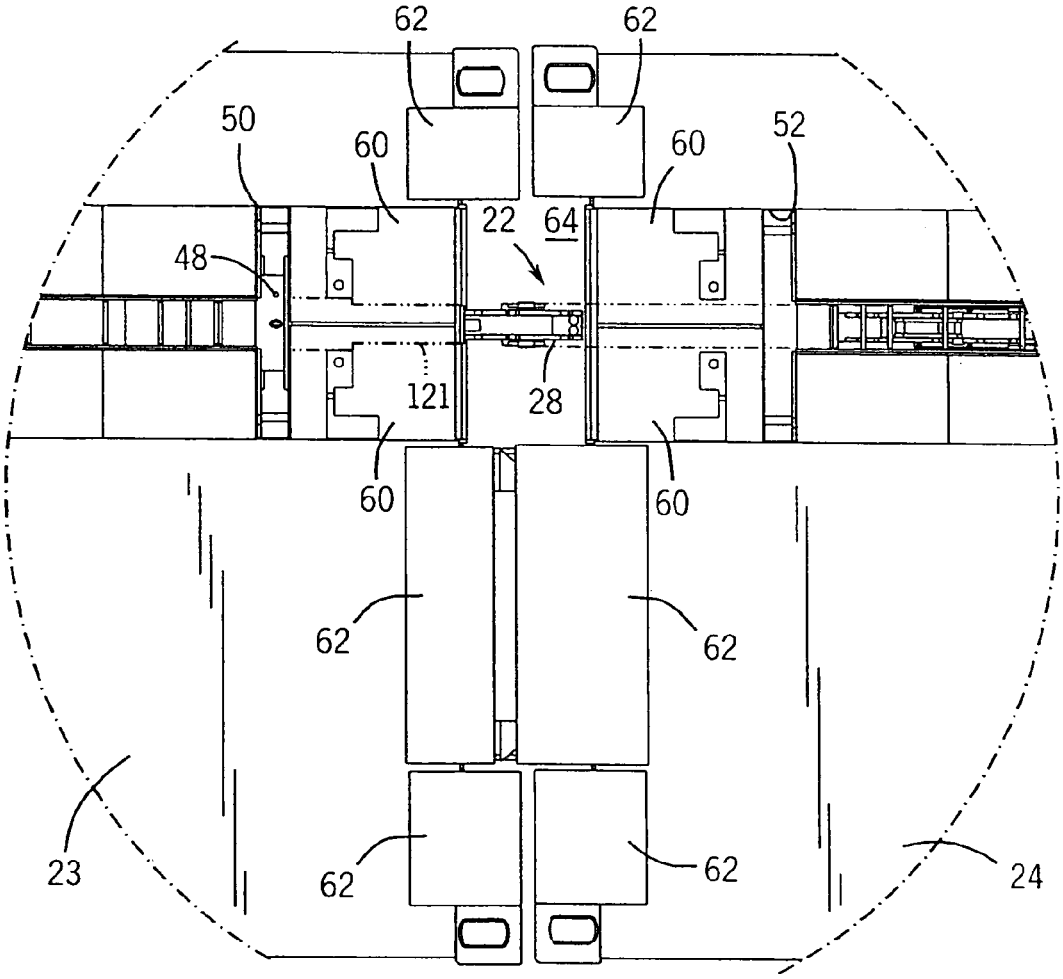
FIG. 6 is a view similar to that of FIG. 5 and with the flexor connector drive shown extended and connected to a flexor connector of a mating modular causeway system section.
Figure 8:
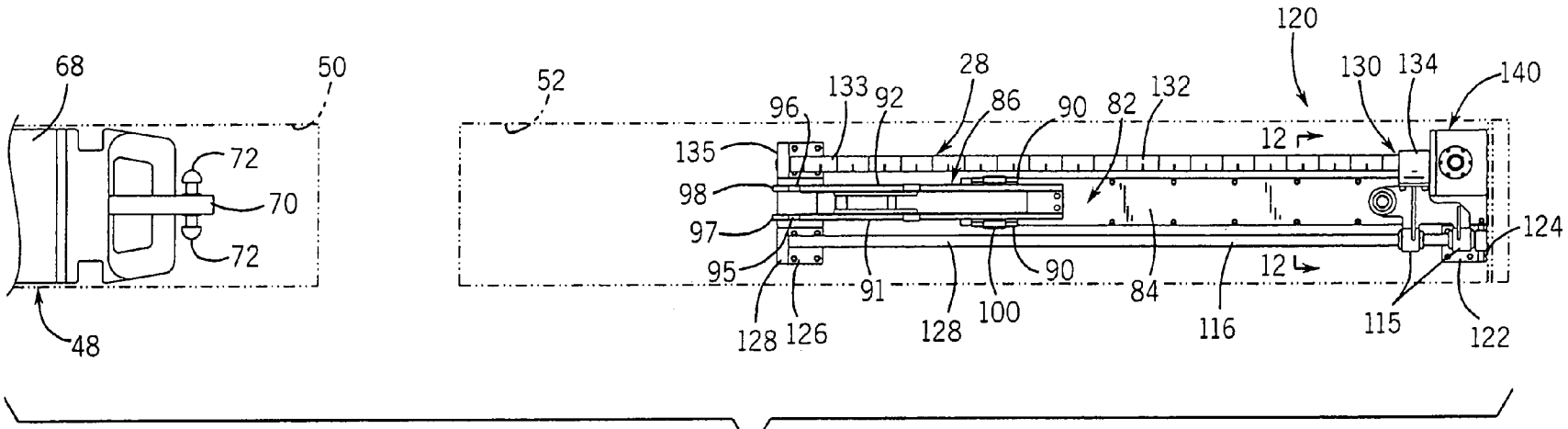
FIG. 8 is a simplified view of a flexor connector drive system of the present invention of a modular causeway system section, and with a linear slide mechanism of the flexor drive shown retracted into a flexor well.
Figure 9:
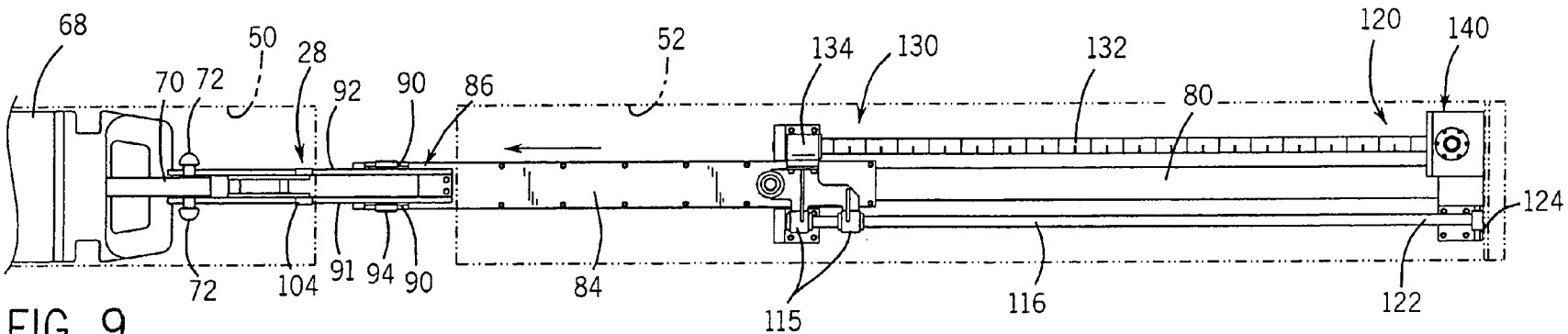
FIG. 9 is a view similar to that of FIG. 8 and showing the linear slide mechanism extended and connected to a flexor connector of a mating modular causeway system section.
Figure 10:
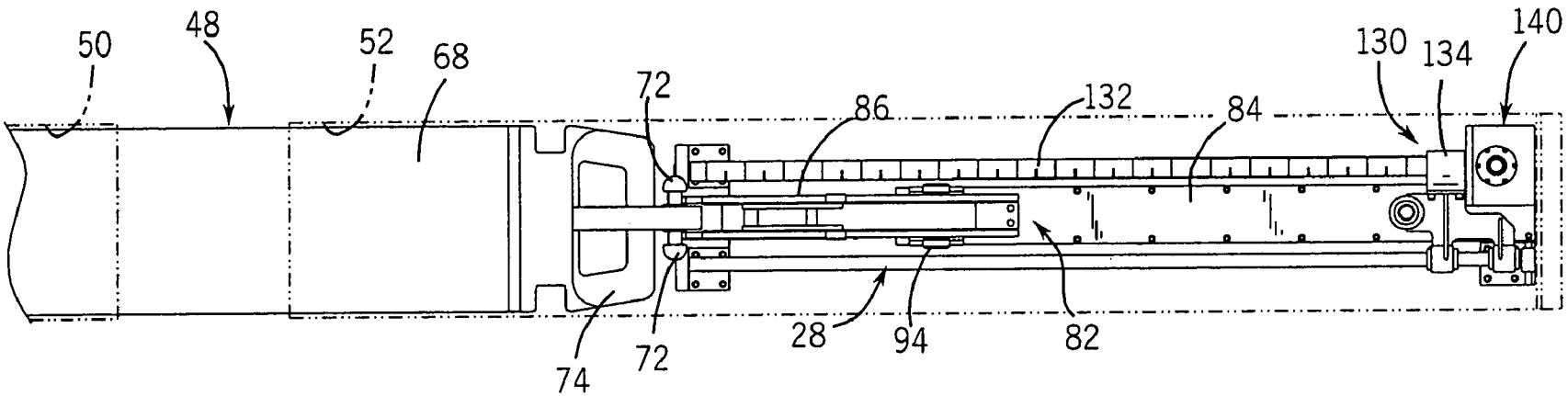
FIG. 10 is a view similar to that of FIG. 9 and showing the carriage assembly and the flexor connector connected thereto retracted back into the flexor well.

Referring to FIGS. 5 and 6, the MCS sections 23 and 24 are shown disposed in an abutting end-to-end relation. A linear slide mechanism 28 of the flexor connector drive system 22 is mounted within the well 52 for reciprocating drive between a retracted position and an extended position. Referring also to FIGS. 8-10, in FIGS. 5 and 8, the linear slide mechanism 28 is shown in its retracted position within flexor well 52. In FIGS. 6 and 9, the linear slide mechanism 28 is shown in its extended position, with its distal end extending into flexor well 50 of the left end rake 23. The distal end of the linear slide mechanism 28 is connected to the flexor connector 48 of the left end rake 23, allowing the flexor connector 48 to be drawn back into the well 52 of the MCS section 24 by retracting the linear slide mechanism 28 back into the MCS section 24 as shown in FIG. 10.

As shown in FIG. 5, the flexor connector 48 is located within a flexor well 50 on the left end rake of MCS section 23. The flexor well 50 is open ended on the side facing the mating MCS section 24 as shown in FIG. 1. In addition, the flexor well 50 can be open at its upper end, with the open upper end being closed by one or more cover plates 60. Removable plates 62 can be positioned over at least a portion of a gap 64 provided between the two MCS sections or modules 23 and 24. A further removable cover 63 can be positioned over a gear drive 140 of the of the flexor connector drive system 22.

The linear slide mechanism 28 is normally contained within the flexor well 52 in the MCS section 24 in the position shown in FIG. 5, and is adapted to be driven outwardly to the position shown in FIG. 6 where the linear slide mechanism couples to the flexor connector 48 of the mating section 23. The linear slide mechanism 28 is then driven back into the flexor well 52 to the position shown in FIG. 10, drawing with it the flexor connector 48, the distal end of which is thus drawn into the flexor well 52, for stabilizing the connection between the two MCS sections 23 and 24, with the flexor connector 48 connecting the left rear of the MCS section 23 to the left front of the MCS section 24.

Flexor Connector

Figure 7:
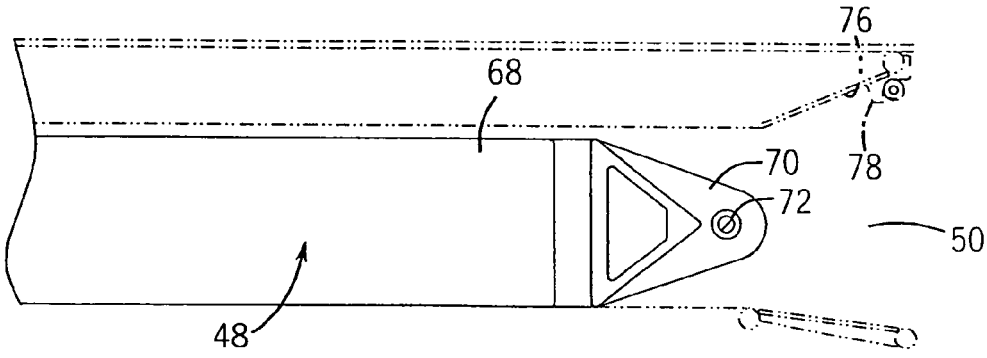
FIG. 7 is a fragmentary view of the flexor connector of FIG. 5.

Referring to FIGS. 7 and 8, the flexor connector 48 is a solid, elongated beam 68 that is generally rectangular in cross-section. Typically, such flexor connectors can weigh approximately 1100 pounds. The beam includes a nose end portion or receptor 70 having a pair of pull pins 72 that are located on opposite sides of the receptor 70. The pull pins 72 facilitate connection of the linear slide mechanism 28 to the flexor connector 48, allowing the flexor connector to be drawn out of the well 50 on the module 23, across the gap 64 and into the well 52 on the module 24 as will be shown.

The flexor connector 48 is supported within the well 50 for sliding linear movement between a stowed position, shown in FIG. 5, in which the flexor connector 48 is recessed within the module 23 and a deployed position, shown in FIG. 10, in which the distal end portion 74 of the flexor connector 48 is located within the flexor well 52 of the mating module 24. The flexor connector is connected to the module 23. The sides of the beam can be guided by the sidewalls of the well 50. Alternatively, the flexor connector 48 can be supported on one or more tracks located in the well 50.

An inner surface 76 of the well 50 defines a stop surface that is formed by a downwardly extending projection 78. The stop surface 78 cooperates with the linear slide mechanism 28 for disconnecting the linear slide mechanism 28 from the flexor connector 48 to allow the MCS section 23 to be disconnected from the MCS section 24, as will be shown.

Flexor Connector Drive System

Referring to FIGS. 8-11, the linear slide mechanism 28 includes a slide assembly 82 that rides on a track 80. The slide assembly 82 is reciprocated by a linear drive mechanism 120 between a retracted position shown in FIG. 8 and an extended position shown in FIG. 9.

Figure 12:
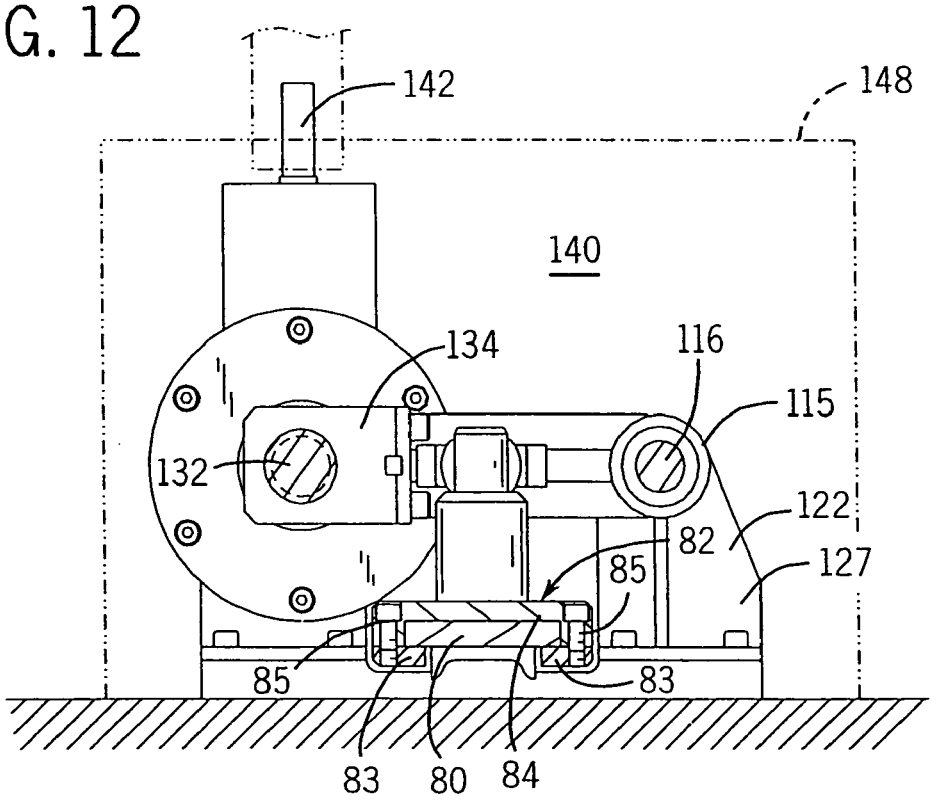
FIG. 12 is a vertical section view taken along the line 12-12 of FIG. 8.
Figure 13:
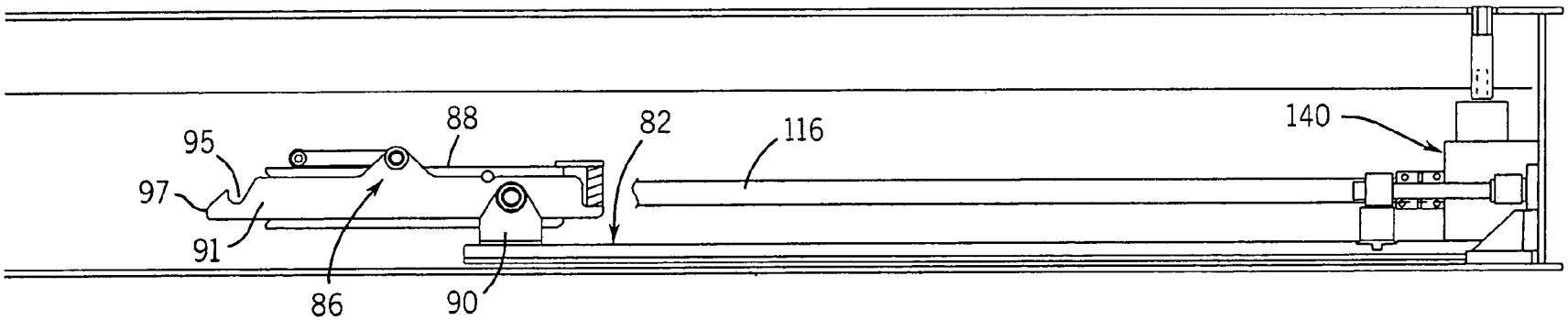
FIG. 13 is a side elevation view of the linear drive mechanism.

Referring to FIGS. 9, 12 and 13, the track 80 is an elongated flat member, generally rectangular in shape. The track 80 extends longitudinally of the flexor well 52 over about three-fourths the length of thereof and is supported on the bottom of the well 52.

Referring to FIGS. 8, 9, 12 and 13, the slide assembly 82 includes a slide 84 and a carriage assembly 86 that is carried by the slide 84. The slide 84 includes a flat plate, generally rectangular in shape and approximately the same length as the track 80. The slide 80 is adapted for sliding movement along the upper surface of the track 80 is secured to the track 80 by retention plates 83 that extend underneath the longitudinal edges of the track 80 and are fastened to the slide 84 by bolts 85. The retention plates 83 keep the slide 84 from tilting relative to the track 80 as the slide is reciprocated.

The carriage assembly 86 includes a base 88 that is supported on the slide 84 a pair of brackets 90. The carriage assembly 86 further includes a pair of link arms 91 and 92 that are pivotably mounted to the base 88 by a pivot 94 supported at opposite ends by the pair of mounting brackets 90. The link arms 91 and 92 include slide hooks 95 and 96, respectively, near their respective distal ends 97 and 98. The link arms 91 and 92 are adapted to be pivoted downwardly away from a home position, shown in FIG. 11, to the position shown in FIG. 19 to allow the linear slide mechanism 28 to be connected to the flexor connector 48 when the two MCS sections are being connected together and disconnected from the flexor connector 48 when the two MCS sections are being disconnected from one another. The carriage assembly includes a restoring spring 102 for returning the link arms 91 and 92 to the home position when released. The restoring spring 102 is located at the proximal end 104 of the link arm 91, mounted between an extension 106 of the link arm 91 and an extension 108 of the base 88. At least one link arm, such as link arm 91, includes a notch 109 that cooperates with a travel limit stop 110 on the base 88 to stop the pivoting of the link arms 91 and 92 when the home position is reached.

The carriage assembly 86 further includes a disconnect link bar 112 that is mounted to the link arms by a pivot 114. The pivot 114 is located near the center of the link arms 91 and 92 and allows the disconnect link bar 112 to be pivoted between a stowed position shown in FIG. 17 and a deployed position shown in FIG. 18.

Referring to FIGS. 8, 9 and 12, the carriage assembly 86 includes guides 115 that are slidably movable on a guide bar 116 that extends parallel to the slide track 80. The proximal end 122 of the guide bar 116 is supported by a pedestal 124. The distal end 126 of the guide bar 116 is supported by a pedestal 128.

Linear Drive Mechanism

Referring to FIGS. 8 and 9, the linear drive mechanism 120 includes a mechanical screw drive 130 and a gear drive 140. The mechanical screw drive 130 includes a drive screw 132 and a drive nut 134. The drive screw 132 is located at one side of the well 52 and extends longitudinally of the well 52, parallel to the slide track 80.

Figure 14:
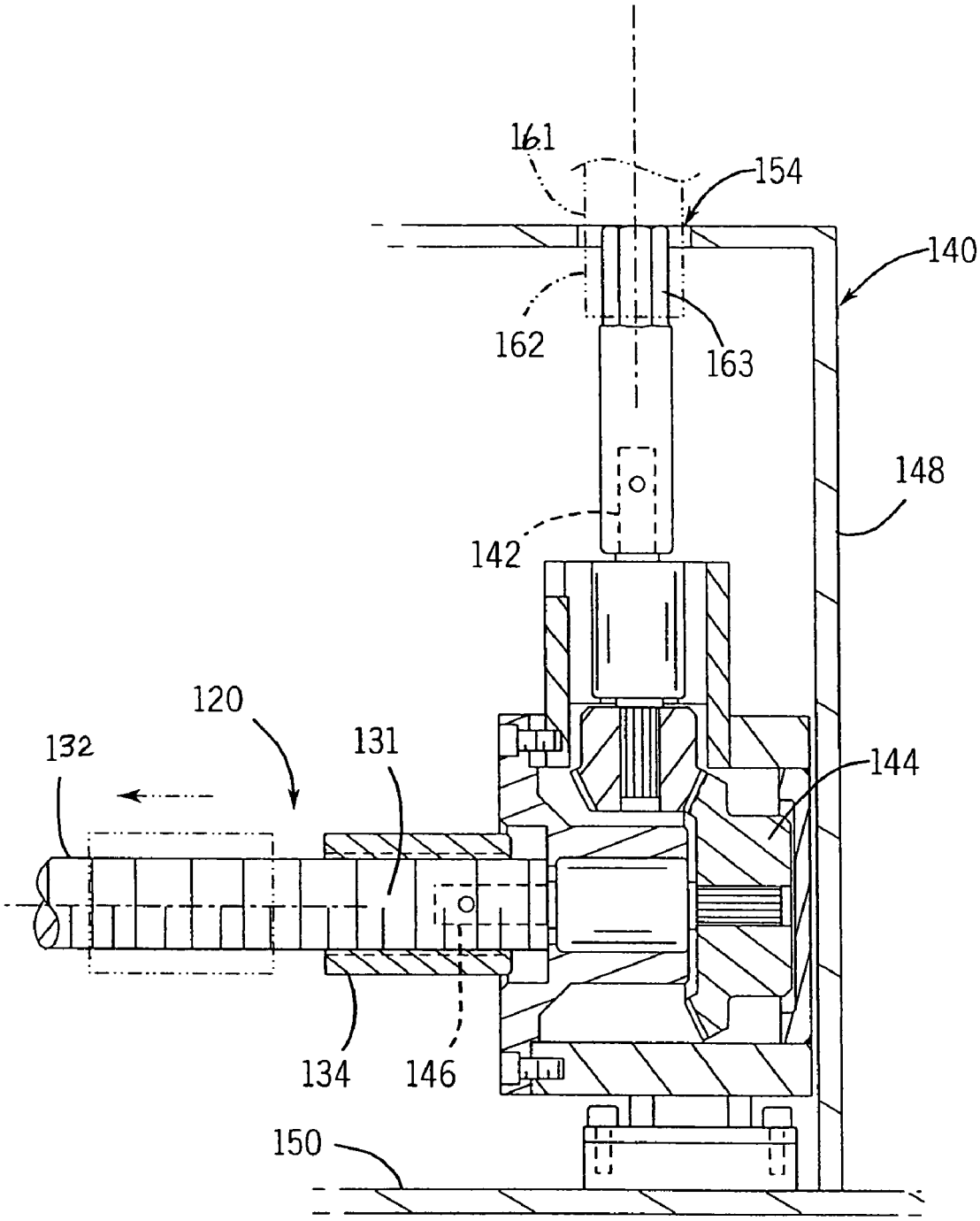
FIG. 14 is an enlarged vertical view of a gear drive of the linear drive mechanism of FIG. 13.

Referring to FIGS. 8, 12 and 14, the proximal or driven end 131 of the drive screw 132 is coupled to the gear drive 140 which is mounted in the well 52 near the back end of the well 52. The distal end 133 of the drive screw 132 is supported by a support 135 near the forward end of the well 52. The slide 84 is coupled to the drive screw 132 by the drive nut 134 which is fixed to the slide 84.

Preferably the screw 132 is a high helix screw that provides high torque under high speed conditions. The mechanical screw drive transmits linear motion through the low rpm high speed screw drive to the linear slide mechanism 28. By way of example, the mechanical screw drive 130 can be similar to that is disclosed in U.S. Pat. No. 4,790,971. More specifically, the mechanical screw drive includes a drive screw and a nut having threads coactive with the threads of the screw and the threads of the nut formed to minimize tolerances between threads of the screw and the threads of the nut. The drive screw 132 can be used in a linear drive mechanism for shuttling loads of more than 1100 pounds at high speeds up to or in excess of 300 feet per minute, for example.

When rotated in one direction, the screw 132 drives the nut 134 to extend the slide 84 outwardly, allowing the link arms 91 and 92 to latch onto the pull pins 72 of the flexor connector 48 on the adjacent MCS section 23. Then, when the direction of rotation of the screw 132 is reversed, the nut 134 is driven in the opposite direction to pull the flexor connector 48 out of the well 50 and into the mating well 52 in the MCS section 24.

Gear Drive

Referring to FIGS. 12 and 14, the gear drive 140 includes an input drive shaft 142 that is coupled through a gear mechanism 144 to an output drive shaft 146. The drive screw 132 can be connected to the output drive shaft 144 in any suitable manner. The input drive shaft 142 is adapted for coupling to a drive motor. The gear mechanism 144 includes a set of right angle bevel gears to permit a right angle connection to a drive motor. The gear mechanism 144 is enclosed within a housing 148 that is supported on the frame 150 of the linear slide mechanism 28. The housing 148 has an opening 154 to permit coupling of the shaft of a drive motor to the input drive shaft 142.

Portable Driver

Figure 15:
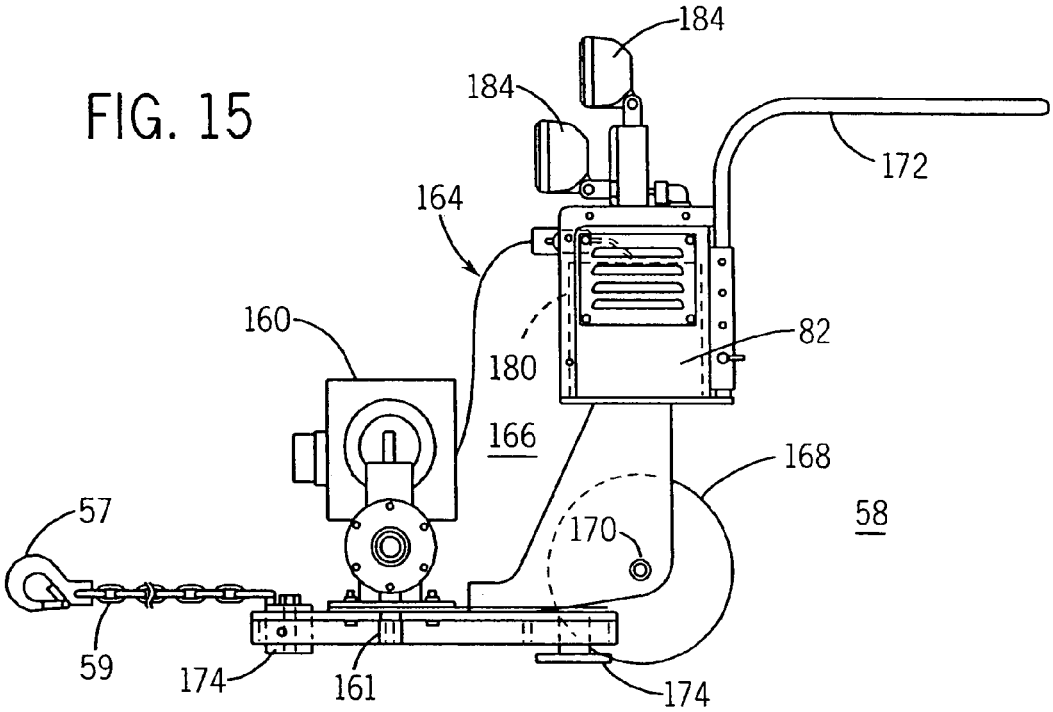
FIG. 15 is a side elevation view of a portable DC drive used to drive the linear drive mechanism of the present invention.
Figure 16:
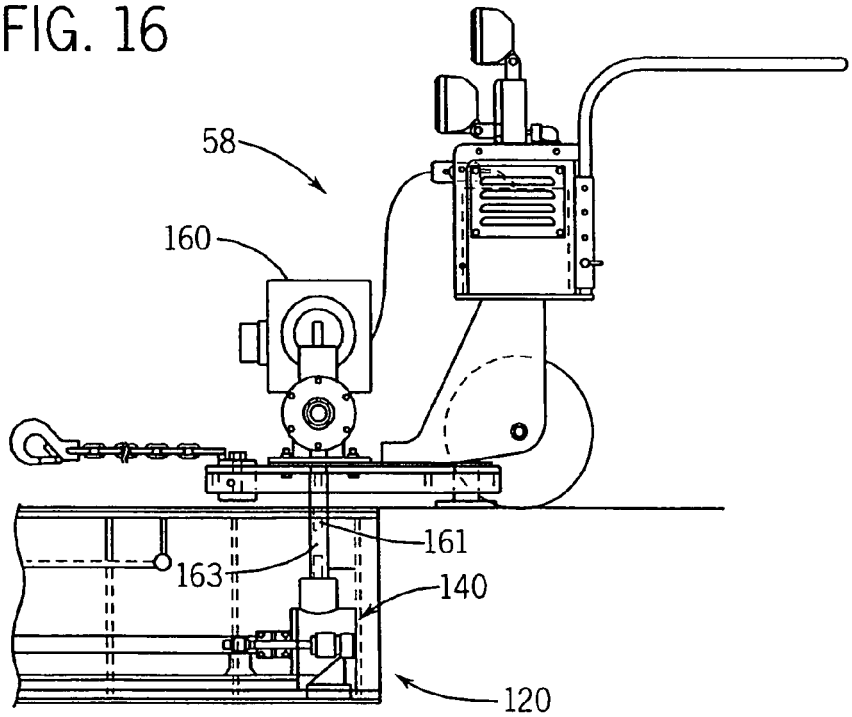
FIG. 16 is a side elevation view of the portable DC drive of FIG. 15, shown connected to the gear drive shown in FIG. 14.

Referring to FIGS. 14-16, the linear drive mechanism 120 can be powered by a DC drive motor 160 of a winch mechanism 58. In accordance with the invention, the winch assembly 58 is portable and can be moved to any location on an MCS section coupled to the gear drive at that location. Thus, a single drive motor 160 can be used for several linear drive mechanisms at different locations on an MCS section. However, a separate drive motor can be provided for each linear drive mechanism, such as linear drive mechanism 120, with the drive motor mounted within the well 52 and coupled directly to the drive screw 132.

The DC drive motor 160 is adapted to be coupled to the gear drive 140. The drive motor 160 includes a drive shaft 161. The motor drive shaft 161 includes a right angle female hex drive 162 shown in FIG. 15. The right angle female hex drive 162 projects downwardly from the winch assembly 58 and is adapted to mate with a male hex drive 163 carried by the input shaft 142 of the gear drive 140.

The winch assembly 58 includes a cart 164 having a frame 166 that supports the drive motor 160. The cart 164 includes a pair of wheels 168 that are supported on axles 170 suspended by the frame 166. The portable drive can include a handle 172 to facilitate moving the cart into position. The cart 164 includes a plurality of foot pads 174 which can be used to index to the cart 164 to the gear drive 140 to facilitate coupling of the motor drive shaft 161 to the input shaft 142 of the gear drive 140. The foot pads 174 can be received in indentations (not shown) in the upper surface of the MCS section on which it is being used. The winch assembly includes the wire rope 59 with the winch hook 55 to facilitate drawing together two MCS sections that are being interconnected. The portable driver can be battery operated. The battery 180 is contained within a housing 182 that is supported on the frame 166. The cart 164 can also include one or more lights 184.

Digressing, referring to FIG. 1, a given MCS section can include several flexor drives and can be formed by a plurality of MCS sections. In accordance with a feature of the invention, a single drive motor can be used for activating the linear drive of a plurality of flexor drive systems on one or more MCS sections or assemblies.

Operation of the Linear Drive

Referring to FIGS. 1, 3, 4 and 16, the following is a description of how two MCS sections 23 and 24, such as MCS sections 23 and 24, can be connected together using the flexor connector drive system of the present invention. First, the portable driver 58 is coupled to the gear drive 140. The cover 63 over the gear drive 140 is removed, exposing to view the upper end of the gear drive 140. The portable driver 58 set up on the MCS section 24, at the end of the flexor well 52 overlying the gear drive 140 as shown in FIG. 16. Referring also to FIGS. 14 and 15, the motor drive shaft 161 is inserted into the locking lug at the end of the flexor well 52. The right-angle, female hex drive 162 of the DC motor 160 is inserted onto the male drive 163 of the gear drive 140.

The left and right MCS sections 23 and 24 are oriented with the MCS sections generally in line and with the flexor connector 48 aligned with the opening to the flexor well 52 in the MCS section 24. The two MCS sections 23 and 24 are aligned end-to-end and then brought into proximity with one another. The wire rope 59 (FIG. 15) of the winch assembly 58 extended and the winch hook 57 is connected to the eyebar 56 of the opposite MCS section 23. Then, the wire rope 59 is used to pull the assembled MCS sections together until the MCS sections are joined together at the male to female shear connectors 49 (FIG. 1). Tension is maintained on the conjoined MCS sections.

Referring to FIGS. 8-10, the DC drive is activated to transmit linear motion through the low rpm, high speed screw drive 130. The drive motor 160 is activated, rotating the drive screw 132 which causes the nut 134 to be driven forward, moving the linear slide mechanism 28 forward towards MCS section 23. Linear motion is transmitted through the low rpm, high speed screw drive 131 to the linear slide mechanism 28. The linear slide mechanism 28 is extended out of the flexor well 52 moving towards the well 50 the MCS section 23. With continued drive, the linear slide mechanism 28 is extended to bridge the gap 64 between the two sections 23 and 24 and to lock onto the pull pins 72 of the flexor connector 48.

Figure 11:
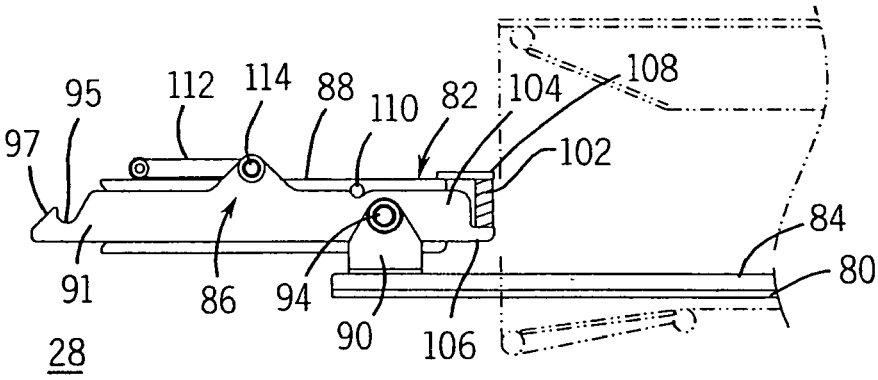
FIG. 11 is a side elevation view of the carriage assembly of the linear slide mechanism of FIG. 8.
Figure 17:
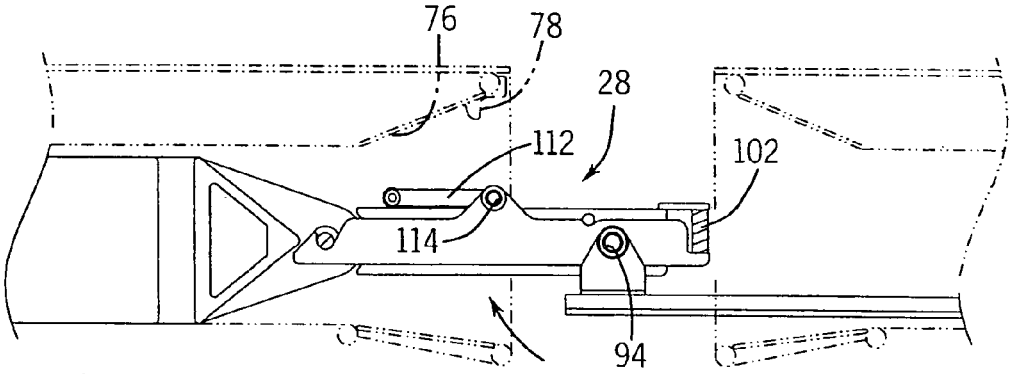
FIG. 17 shows the linear slide mechanism of a flexor connector drive of one modular causeway system section connected to a flexor connector of a mating modular causeway system in accordance with the present invention.

More specifically, referring also to FIG. 11, as the linear slide mechanism 28 reaches the distal end of the flexor connector 48, the forward ends of the two link arms 91 and 92 engage the pull pins 72 which ride along the sloping surfaces of the distal ends 97 and 98 of the link arms 91 and 92, causing the link arms to be deflected downwardly to pass under the pull pins 72. With continued forward movement of the linear slide mechanism 28, the pull pins 72 will fall into the slide hooks 95 and 96, allowing the link arms to be pivoted upwardly, so that the pull pins 72 are captured by the slide hooks 95 and 96 as shown in FIGS. 9 and 17, for example, connecting the linear slide mechanism 28 to the flexor connector 48.

When the pull pins 72 are captured by the slide hooks 95 and 96, connecting the linear slide mechanism 28 to the flexor connector 48, the flexor drive is reversed and the linear slide mechanism 28 pulls the flexor connector 48 rearwardly out of the well 50, across the gap 64 and into the well 52 on the rear MCS section 24 as shown in FIG. 10. A manual lock can be applied to lock the flexor connector 48 to the flexor receptor. The portable driver 58 can be disconnected from the gear drive 140 and removed from the MCS section 24.

Subsequently, when the MCS sections 23 and 24 are to be disconnected from one another, the opposite sequence of operations is followed. The portable driver 58 is positioned for coupling the motor drive shaft 161 to the input shaft 142 of the gear drive 140 as shown in FIG. 16. The lock, if used, is released. The disconnect link bar 112 is engaged by rotating the disconnect link bar 112 upwardly from the storage position, shown in FIGS. 11 and 13, for example, to its deployed position, shown in FIG. 18. In the deployed position, the disconnect link bar 112 projects upwardly from the upper surface of the linear slide mechanism 128.

Then, the DC motor right angle female hex drive 162 is inserted onto male right angle gear drive 163 to couple gear drive 140 to the motor drive shaft 161. When the drive motor 160 has been connected to the gear drive 140, the DC drive is operated to transmit linear motion through the screw drive 131 to the linear slide mechanism 28. The motor 160 is activated and the linear slide mechanism 28 is driven outwardly in the direction of the arrow 190, pushing the flexor connector 48 out of the well 52 and into the well 50 of the forward section. The carriage assembly 86 pushes the flexor connector 48 towards the MCS section 23.

Figure 18:
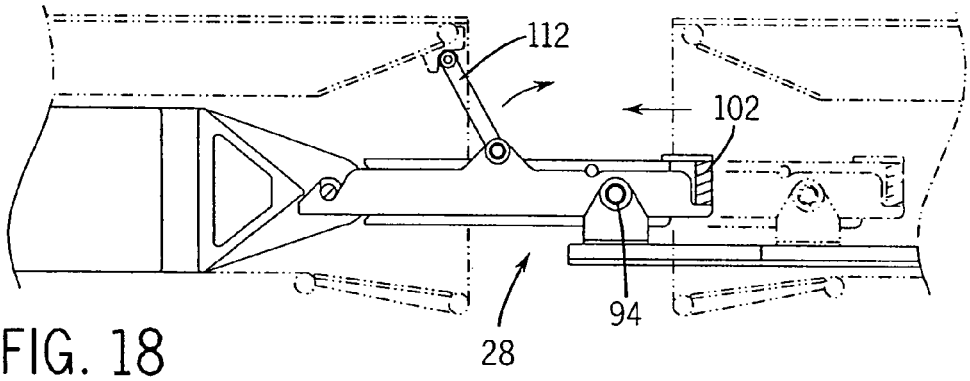
FIGS. 18-19 how steps in the process of disconnecting the linear slide mechanism of FIG. 17 from the flexor connector.
Figure 19:
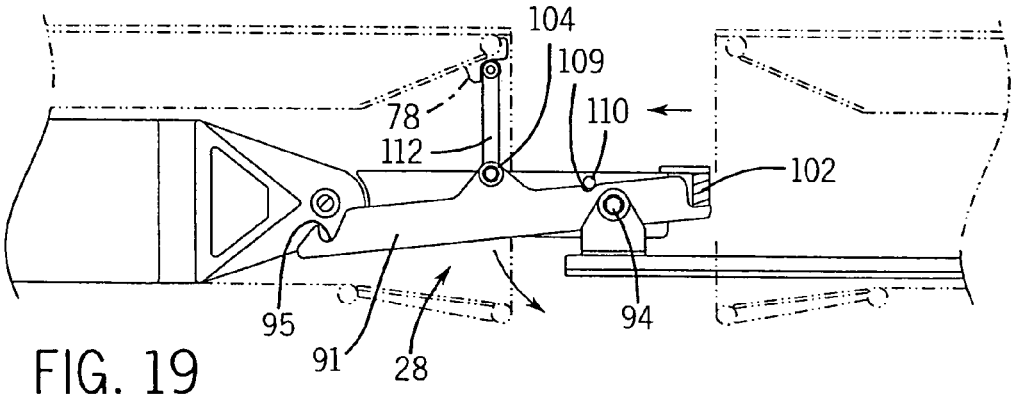

Continued drive motion of the linear slide mechanism 28 causes the disconnect link bar 112 to press down on the link arms 91 and 92. Referring to FIG. 18, when the upper end of the disconnect link bar 112 engages the stop surface 78 of the well 50, the disconnect link bar 112 is pivoted rearwardly, in the direction of the arrow 192, which causes the link bars 91 and 92 to be pivoted downwardly about the pivot 94, as shown in FIG. 19. The disconnect link bar 112 pushes down on the link arms 91 and 92 against the force of the bias spring 102, freeing the linear slide mechanism 28 from the pivot pins 72. This is due to the change in radius of the disconnect link bar 112 as it is pivoted as the linear slide mechanism 28 moves past the stop surface 78, moving the slide hooks 94 and 95 out of engagement with the pull pins 72, completing the disengagement of the slide hooks 95 and 96 from the pull pins 72. When the link arms 91 and 92 have cleared the pull pins 72, the link arms are returned to the home position by the bias force produced by the spring 102. The extended linear slide mechanism 28 completes stowage of the flexor connector 48 in the well 50.

When the flexor connector 48 has been stowed, the direction of rotation of the drive screw 132 is reversed, reversing the direction of travel of the linear slide mechanism 28 driving the linear slide mechanism 28 back towards the flexor well 52 in the MCS section 24. The linear slide mechanism 28 is retracted back into the well 52 until it reaches the fully stowed position.

It may therefore be appreciated from the above detailed description of the preferred embodiment of the present invention that it provides a flexor connector system and apparatus for drawing together, aligning and linking together two or more sections of a floatation system in a seawater environment. In interconnecting two sections, a slide mechanism within a well of a first section is driven by a linear drive to the second section where it automatically couples to a flexor connector. The slide mechanism is retracted back into the well of the first section drawing with it the flexor connector. The connection of the slide mechanism to and the disconnection of the slide mechanism from the flexor connector is provided automatically. In addition, the linear drive includes a drive screw apparatus having a high helix screw that provides high torque under high speed conditions. The drive screw apparatus is driven by a drive motor that is portable and can be moved to any location on a section, allowing a single drive motor to be used for several linear drives at different locations on a section.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A connector system for interconnecting first and second sections of a floatation system in a seawater environment, the first and second sections being aligned in an end-to-end or side-by-side orientation, said connector system comprising:

a flexor connector mounted for sliding movement within a first well of the first section; and a flexor connector drive system including at least one slide mechanism mounted within a second well of said second section for sliding movement within said second well;

at least one drive mechanism coupled to said slide mechanism at a driving end thereof, said drive mechanism including a linear drive coupled to said slide mechanism at said driving end, and a drive motor coupled to said linear drive for driving said slide mechanism in a first direction to push said slide mechanism out of said second well toward said first section for coupling said slide mechanism to said flexor connector; and said drive mechanism being reversible, allowing said drive motor and said linear drive to drive said slide mechanism, with said slide mechanism coupled to said flexor connector, in a direction opposite said first direction, to pull said slide mechanism and said flexor connector from said first well at least partially into said second well.

2. The connector system according to claim 1, wherein said linear drive is driven by said drive motor for imparting reciprocating linear movement to said slide mechanism.

3. A connector system for interconnecting first and second sections of a floatation system in a seawater environment, the first and second sections being aligned in an end-to-end or side-by-side orientation, said connector system comprising:

a flexor connector mounted for sliding movement within a first well of the first section; and a flexor connector drive system including at least one slide mechanism mounted within a second well of said second section for sliding movement within said second well;

at least one drive mechanism coupled to said slide mechanism for driving said slide mechanism in a first direction toward said first section for coupling said slide mechanism to said flexor connector; said drive mechanism including a drive motor and a linear drive that is driven by said drive motor for imparting reciprocating linear movement to said slide mechanism, said drive mechanism being reversible for driving said slide mechanism, with said slide mechanism coupled to said flexor connector, in a direction opposite said first direction, thereby drawing said flexor connector from said first well at least partially into said second well, wherein said linear drive includes a drive screw apparatus, said drive motor coupled to said drive screw apparatus.

4. The connector system according to claim 3, wherein said drive screw apparatus includes a high helix screw that provides high torque under high speed conditions.

5. A connector system for interconnecting first and second sections of a floatation system in a seawater environment, the first and second sections being aligned in an end-to-end or side-by-side orientation, said connector system comprising:

a flexor connector mounted for sliding movement within a first well of the first section; and a flexor connector drive system including at least one slide mechanism mounted within a second well of said second section for sliding movement within said second well;

at least one drive mechanism coupled to said slide mechanism for driving said slide mechanism in a first direction toward said first section for coupling said slide mechanism to said flexor connector; said drive mechanism including a drive motor and a linear drive that is driven by said drive motor for imparting reciprocating linear movement to said slide mechanism, said drive mechanism being reversible for driving said slide mechanism, with said slide mechanism coupled to said flexor connector, in a direction opposite said first direction, thereby drawing said flexor connector from said first well at least partially into said second well, wherein said drive motor is relocatable with respect to said slide mechanism, and including a portable cart adapted for movement along a deck surface of said second section, said drive motor carried by said cart.

6. The connector system according to claim 5, and further including a gear drive for coupling said drive motor to said linear drive.

7. The connector system according to claim 5, and including a further drive mechanism on said second section, and wherein said cart is adapted for movement along said deck surface of said second section to allow coupling said drive motor to either of said drive mechanisms.

8. The connector system according to claim 7, wherein said slide mechanism is adapted to be disconnected automatically from said flexor connector as the slide mechanism is driven in said opposite direction.

9. A connector system for interconnecting first and second sections of a floatation system in a seawater environment, the first and second sections being aligned in an end-to-end or side-by-side orientation, said connector system comprising:

a flexor connector mounted for sliding movement within a first well of the first section; and a flexor connector drive system including at least one slide mechanism mounted within a second well of said second section for sliding movement within said second well;

at least one drive mechanism coupled to said slide mechanism for driving said slide mechanism in a first direction toward said first section for coupling said slide mechanism to said flexor connector; said drive mechanism including a drive motor and a linear drive that is driven by said drive motor for imparting reciprocating linear movement to said slide mechanism, said drive mechanism being reversible for driving said slide mechanism, with said slide mechanism coupled to said flexor connector, in a direction opposite said first direction, thereby drawing said flexor connector from said first well at least partially into said second well, wherein said drive mechanism drives said slide mechanism in said first direction into engagement with said flexor connector, and wherein said slide mechanism is adapted to be connected to said flexor connector automatically as said slide mechanism is driven into engagement with said flexor connector.

10. The connector system according to claim 9, wherein said drive motor is relocatable with respect to said slide mechanism, and including a portable cart adapted for movement along a deck surface of the second section, the drive motor carried by the cart.

11. The connector system according to claim 9, wherein said slide mechanism is adapted to be disconnected automatically from said flexor connector as the slide mechanism is driven in said opposite direction.

12. A connector system for connecting a first section of a modular causeway system to a second section of a modular causeway system in a seawater environment, the first and second sections being aligned in end-to-end or side-by-side orientation, said connector system comprising:

a flexor connector contained within a first well on the first section, said flexor connector mounted with said first well for reciprocating sliding movement; and a flexor connector drive system including a linear slide mechanism contained within a second well of the second section; said linear slide mechanism mounted for sliding movement within said second well, said linear slide mechanism adapted to be coupled to said flexor connector;

a linear drive coupled to said linear slide mechanism for driving said linear slide mechanism in a first direction from said second well into engagement with said flexor connector to couple said linear slide mechanism to said flexor connector, and a drive motor driving said linear drive for imparting reciprocating linear movement to said slide mechanism, said linear drive being reversible for driving said linear slide mechanism, with said linear slide mechanism coupled to said flexor connector, in a direction opposite said first direction, thereby drawing the flexor connector from said first well and at least partially into said second well, said linear drive including a drive screw apparatus, and further including a gear drive for coupling said drive motor to said drive screw apparatus.

13. A connector system for connecting a first section of a modular causeway system to a second section of a modular causeway system in a seawater environment, the first and second sections being aligned in end-to-end or side-by-side orientation, said connector system comprising:

a flexor connector contained within a first well on the first section, said flexor connector mounted with said first well for reciprocating sliding movement; and a flexor connector drive system including a linear slide mechanism contained within a second well of the second section; said linear slide mechanism mounted for sliding movement within said second well, said linear slide mechanism adapted to be coupled to said flexor connector;

a linear drive coupled to said linear slide mechanism for driving said linear slide mechanism in a first direction from said second well into engagement with said flexor connector to couple said linear slide mechanism to said flexor connector, said linear drive being reversible for driving said linear slide mechanism, with said linear slide mechanism coupled to said flexor connector, in a direction opposite said first direction, thereby drawing the flexor connector from said first well and at least partially into said second well, wherein said slide mechanism is adapted to be connected to said flexor connector automatically as said slide mechanism is driven toward said flexor connector.

14. The connector system according to claim 13, wherein the flexor connector includes an appendage, and wherein said slide mechanism includes a receptor for receiving said appendage thereby coupling said slide mechanism to said flexor connector.

15. The connector system according to claim 14, wherein said appendage comprises at least one pull pin, and wherein said receptor of said linear slide mechanism comprises at least one slide hook adapted to engage said pull pin to connect said slide hook to said pull pin, thereby coupling said linear slide mechanism to said flexor connector.

16. A connector system for connecting a first section of a modular causeway system to a second section of a modular causeway system in a seawater environment, the first and second sections being aligned in end-to-end or side-by-side orientation, said connector system comprising:

a flexor connector contained within a first well on the first section, said flexor connector mounted with said first well for reciprocating sliding movement; and a flexor connector drive system including a linear slide mechanism contained within a second well of the second section; said linear slide mechanism mounted for sliding movement within said second well, said linear slide mechanism adapted to be coupled to said flexor connector;

a linear drive coupled to said linear slide mechanism for driving said linear slide mechanism in a first direction from said second well into engagement with said flexor connector to couple said linear slide mechanism to said flexor connector, said linear drive being reversible for driving said linear slide mechanism, with said linear slide mechanism coupled to said flexor connector, in a direction opposite said first direction, thereby drawing the flexor connector from said first well and at least partially into said second well, wherein said slide mechanism includes a disconnect mechanism adapted to automatically disconnect said slide mechanism from said flexor connector as the slide mechanism is driven in said opposite direction.

17. The connector system according to claim 16, wherein said disconnect mechanism includes a disconnect link member positionable to cooperate with a surface of said first section for automatically causing disconnection of a slide hook of said linear slide mechanism from a pull pin of said flexor connector, thereby decoupling said linear slide mechanism from the flexor connector, as said slide mechanism is driven in said opposite direction.

18. A connector drive system for moving a slide mechanism into connecting engagement with a flexor connector for interconnecting first and second sections of a modular causeway system in a seawater environment, wherein the first section includes a flexor connector contained within a first well; and said second section includes a second well, the first and second sections being oriented with the first and second wells in alignment, said connector drive system comprising:

a slide mechanism mounted within the second well for reciprocating sliding movement; and a drive mechanism coupled to said slide mechanism for driving said slide mechanism in a first direction from said second well toward said first well, said slide mechanism adapted to be coupled to said flexor connector when said slide mechanism is at least partially in said first well;

said drive mechanism being reversible for driving said slide mechanism, with said slide mechanism connected to the flexor connector, in a direction opposite said first direction, thereby pulling the flexor connector from said first well at least partially into said second well, wherein said drive mechanism is contained within the second well.

19. The connector drive system according to claim 18, wherein said drive mechanism includes a linear drive mechanism including drive screw apparatus.

20. A connector system for moving a slide mechanism into connecting engagement with a flexor connector for interconnecting first and second sections of a modular causeway system in a seawater environment, wherein the first section includes a flexor connector contained within a first well; and said second section includes a second well, the first and second sections being oriented with the first and second wells in alignment, said connector drive system comprising:

a slide mechanism mounted within the second well for reciprocating sliding movement; and a drive mechanism coupled to said slide mechanism for driving said slide mechanism in a first direction from said second well toward said first well, said slide mechanism adapted to be coupled to said flexor connector when said slide mechanism is at least partially in said first well;

said drive mechanism being reversible for driving said slide mechanism, with said slide mechanism connected to the flexor connector, in a direction opposite said first direction, thereby pulling the flexor connector from said first well at least partially into said second well, wherein said slide mechanism is adapted to be connected to said flexor connector automatically as said slide mechanism is driven toward said flexor connector.

21. The connector system according to claim 20, wherein the flexor connector includes an appendage, and wherein said slide mechanism includes a receptor for receiving said appendage to thereby coupling said linear slide mechanism to said flexor connector.

22. The connector drive system according to claim 21, wherein said appendage comprises at least one pull pin, and wherein said receptor of said slide mechanism comprises at least one slide hook adapted to engage said pull pin to connect said slide hook to said pull pin, thereby coupling said slide mechanism to said flexor connector.

23. The connector drive system according to claim 22, wherein said slide mechanism includes a disconnect link member positionable to cooperate with a surface of said first section for automatically causing disconnection of said slide hook from said pull pin, thereby decoupling said slide mechanism from the flexor connector, as said slide mechanism is driven in said opposite direction.

24. The connector system according to claim 20, wherein said slide mechanism is adapted to be disconnected automatically from said flexor connector as the slide mechanism is driven in said opposite direction.

25. A method for interconnecting first and second sections of a floatation system in a seawater environment, at least one of the sections including a flexor connector located within a first well on the first section said method comprising the steps of:

providing a slide mechanism within a second well located on the second section;

aligning the first and second sections in an end-to-end or side-by-side orientation with the first well aligned with the second well;

transmitting motion to the slide mechanism to cause the slide mechanism to be moved in a first direction out of the second well and into engagement with said flexor connector, including causing the slide mechanism to be moved linearly in a first direction out of the second well and into engagement with the flexor connector;

coupling the slide mechanism to the flexor connector; and reversing the direction of the linear drive to cause the slide mechanism to be retracted back into the second well, drawing the flexor connector at least partially into the second well, wherein the step of coupling the slide mechanism to the flexor connector includes automatically connecting the slide mechanism to the flexor connector as the slide mechanism is driven into engagement with the flexor connector.

26. A method for interconnecting first and second sections of a floatation system in a seawater environment, at least one of the sections including a flexor connector located within a first well on the first section said method comprising the steps of:

providing a slide mechanism within a second well located on the second section;

aligning the first and second sections in an end-to-end or side-by-side orientation with the first well aligned with the second well;

transmitting motion to the slide mechanism to cause the slide mechanism to be moved in a first direction out of the second well and into engagement with said flexor connector, including causing the slide mechanism to be moved linearly in a first direction out of the second well and into engagement with the flexor connector;

coupling the slide mechanism to the flexor connector; and reversing the direction of the linear drive to cause the slide mechanism to be retracted back into the second well, drawing the flexor connector at least partially into the second well, and including the steps of using the slide mechanism to move the flexor connector from the second well back to the first well, and automatically disconnecting the flexor connector from the slide mechanism as the flexor connector is moved into the first well.

27. A method for interconnecting first and second sections of a floatation system in a seawater environment, at least one of the sections including a flexor connector located within a first well on the first section said method comprising the steps of:

providing a slide mechanism within a second well located on the second section;

aligning the first and second sections in an end-to-end or side-by-side orientation with the first well aligned with the second well;

transmitting motion to the slide mechanism to cause the slide mechanism to be moved in a first direction out of the second well and into engagement with said flexor connector;

coupling the slide mechanism to the flexor connector; and reversing the direction of the drive to cause the slide mechanism to be retracted back into the second well, drawing the flexor connector at least partially into the second well, wherein the step of coupling the slide mechanism to the flexor connector includes automatically connecting the slide mechanism to the flexor connector as the slide mechanism is driven into engagement with the flexor connector.

28. The method according to claim according to claim 27, including the steps of using the slide mechanism to move the flexor connector from the second well back to the first well, and automatically disconnecting the flexor connector from the slide mechanism as the flexor connector is moved into the first well.

29. The method according to claim 27, wherein the step of transmitting motion includes activating a drive motor to operate a linear drive mechanism that is coupled to the slide mechanism.

30. The method according to claim 29, wherein the step of transmitting motion to the slide mechanism includes causing the slide mechanism to be moved linearly in a first direction out of the second well and into engagement with the flexor connector.

31. The method according to claim 29, wherein the linear drive mechanism includes a drive screw apparatus including a drive screw and a drive nut, and wherein transmitting motion includes rotating the drive screw to move the drive nut for moving the slide mechanism.

32. The method according to claim 31, wherein the drive screw comprises a high helix screw that provides high torque under high speed conditions.

33. The method according to claim 29, wherein the drive motor is carried by a movable cart, allowing the drive motor to be relocated with respect to said slide mechanism, and wherein the step of transmitting motion includes locating the drive motor in the proximity of the slide mechanism and coupling a drive output of the drive motor to the drive screw.

* * * * *

UNITED STATES PATENT AND TRADEMARK OFFICE

CERTIFICATE OF CORRECTION

PATENT NO. : 7,314,017 B2
APPLICATION NO. : 11/243792
DATED : January 1, 2008
INVENTOR(S) : David George Moore It is certified that error appears in the above-identified patent and that said Letters Patent is hereby corrected as shown below:

Col. 3, Line 28 – delete “from the”

Col. 3, Line 40 “connected” should be --connector--

Col. 3, Line 42 “includes” should be --including--

Col. 5, Line 27 “how” should be --show--

Col. 5, Line 61 “plurality separate” should be --plurality of separate--

Col. 6, Line 35 delete “of”

Col. 7, Line 51 “retracted in” should be --retracted position in--

Col. 8, Line 12 delete “of the”

Col. 9, Line 12 “84 a” should be --84 by a--

Col. 9, Line 66 “that is” should be --that which is--

Signed and Sealed this

Nineteenth Day of August, 2008

JON W. DUDAS
*Director of the United States Patent and Trademark Office*